US010220246B2

(12) United States Patent
Lernihan

(10) Patent No.: US 10,220,246 B2
(45) Date of Patent: Mar. 5, 2019

(54) PORTABLE SIT-STAND ELLIPTICAL EXERCISE MACHINE

(71) Applicant: Jody Newgard Lernihan, Vancouver, WA (US)

(72) Inventor: Jody Newgard Lernihan, Vancouver, WA (US)

( * ) Notice: Subject to any disclaimer, the term of this patent is extended or adjusted under 35 U.S.C. 154(b) by 281 days.

(21) Appl. No.: 15/014,761

(22) Filed: Feb. 3, 2016

(65) Prior Publication Data

US 2017/0216660 A1 Aug. 3, 2017

(51) Int. Cl.
*A63B 22/00* (2006.01)
*A63B 22/06* (2006.01)
*A63B 23/04* (2006.01)

(52) U.S. Cl.
CPC ..... *A63B 22/0046* (2013.01); *A63B 22/0015* (2013.01); *A63B 22/0664* (2013.01); *A63B 23/0476* (2013.01); *A63B 2208/0204* (2013.01); *A63B 2208/0228* (2013.01)

(58) Field of Classification Search
CPC ..... A63B 22/04; A63B 22/20–22/203; A63B 22/0664; A63B 2022/067–2022/0688; A63B 2022/0694; A63B 22/0046; A63B 22/0015; A63B 23/0476; A63B 2208/0204; A63B 2208/0228; A63B 22/0017; A63B 22/0023; A63B 22/06; A63B 23/035; A63B 23/03516; A63B 23/03533; A63B 23/04; A63B 23/0405; A63B 23/0423; A63B 69/16; A63B 2208/0233; A63B 2225/09; A63B 2225/093

See application file for complete search history.

(56) References Cited

U.S. PATENT DOCUMENTS 5,613,924 A * 3/1997 Lee ..... A63B 21/055 434/255
6,558,301 B1 * 5/2003 Jackson ..... A63B 21/0552 482/121
7,276,017 B2 * 10/2007 Chen ..... A63B 22/001 482/52

(Continued)

FOREIGN PATENT DOCUMENTS

TW I488670 B 7/2014
TW M508342 U 9/2015

*Primary Examiner* — Gary D Urbiel Goldner
(74) *Attorney, Agent, or Firm* — Muncy, Geissler, Olds & Lowe, P.C.

(57) ABSTRACT

A portable sit-stand elliptical exercise machine includes a seat, a transmission wheel installed at the seat, two linkage mechanisms installed at the transmission wheel, and two mobile pedals respectively installed at the linkage mechanisms. Each linkage mechanism includes a driving portion connected to the transmission wheel, an axle portion disposed at one side away from the transmission wheel, and an adjustment portion disposed between the axle portion and the driving portion. Each mobile pedal is pivotally connected to the axle portion and includes a plurality of assembly portions. Thus, an angle is formed between each mobile pedal assembled to one of the assembly portions and the linkage mechanism to facilitate a user to utilize the portable sit-stand elliptical exercise machine in either a sitting or standing posture, thereby solving issue of a conventional solution that cannot be applied for a dual use of both sitting and standing postures.

5 Claims, 7 Drawing Sheets

(56) References Cited

U.S. PATENT DOCUMENTS

| | | | | |
|---|---|---|---|---|
| 7,377,879 | B1 * | 5/2008 | Chen | A63B 22/001 482/139 |
| 8,894,549 | B2 * | 11/2014 | Colledge | A63B 22/0046 482/4 |
| 8,979,712 | B2 * | 3/2015 | Lo | A63B 21/026 482/51 |
| 2003/0036462 | A1 * | 2/2003 | Ravikumar | A61H 1/0266 482/51 |
| 2005/0003932 | A1 * | 1/2005 | Chen | A63B 22/001 482/52 |
| 2007/0072742 | A1 * | 3/2007 | Chen | A63B 22/001 482/52 |
| 2008/0058168 | A1 * | 3/2008 | Lin | A63B 22/0664 482/52 |
| 2008/0161166 | A1 * | 7/2008 | Lo | A63B 22/001 482/52 |
| 2009/0049950 | A1 * | 2/2009 | Chen | A63B 22/0046 74/594.4 |
| 2009/0124463 | A1 * | 5/2009 | Chen | A63B 22/001 482/52 |
| 2013/0190136 | A1 * | 7/2013 | Watterson | A63B 71/0622 482/8 |
| 2016/0107026 | A1 * | 4/2016 | Hsu | A63B 23/0476 482/80 |
| 2016/0317859 | A1 * | 11/2016 | Dalmia | A63B 21/225 |
| 2016/0361588 | A1 * | 12/2016 | Kuo | A63B 22/0015 |
| 2017/0319898 | A1 * | 11/2017 | Dalmia | A63B 21/225 |

* cited by examiner

PORTABLE SIT-STAND ELLIPTICAL EXERCISE MACHINE

FIELD OF THE INVENTION

The present invention relates to a portable sit-stand elliptical exercise machine, and particularly to a portable elliptical exercise machine that achieves dual sitting and standing applications through adjusting an angle between a linkage mechanism and a mobile pedal.

BACKGROUND OF THE INVENTION

With the rising of fitness awareness in the modern society, various types of exercise machines are constantly introduced. An elliptical exerciser is one of the most common exercise machines in gyms. For example, the Taiwan Patent Publication No. 1488670 discloses a sports equipment with hand elliptical trajectories. The disclosed sports equipment includes a seat, a curved handle mechanism, two leg elliptical mechanisms and two hand elliptical mechanisms. The seat includes a base and a frame fixedly disposed at a front end of the base. The curved handle mechanism is disposed at the frame. The two leg elliptical mechanisms are installed at two opposite sides of the frame, respectively. The two hand elliptical mechanisms are also installed at two opposite sides of the frame, respectively. In an application process of the sports equipment, a user may tread on the two leg elliptical mechanisms with both feet, and hold the two hand elliptical mechanisms by both hands. As such, both legs and both hands of the user are allowed to perform an elliptical exercise trajectory at the two leg elliptical mechanisms and the two hand elliptical mechanism, respectively, to achieve effects of aerobic exercises and to reduce sports injuries of the knees.

Further, due to a large volume of the sports equipment of the above 1488670 disclosure, portable elliptical exercise machines are also developed by manufacturers. For example, the Taiwan Patent Publication No. M508342 discloses an under-desk elliptical walking machine, which includes a body, a pivotal rotating assembly and a pedaling assembly. The pivotal rotating assembly is disposed on the body. The pedaling assembly includes two pedals connected to the pivotal rotating assembly. During an application process of the elliptical walking machine, a user may sit on a chair or a seating plane as desired, and place the under-desk elliptical walking machine on the ground, such that both legs of the user are allowed perform an elliptical exercise trajectory at the two pedals. Thus, the portable elliptical walking machine can be carried by the user and be utilized for sports training at any location as desired.

However, in the elliptical walking machine of the M508342 disclosure, the two pedals are fixedly disposed at the pivotal rotating assembly. If a user intends to stand on the two pedals for exercise, the fixed positions of the two pedals may hinder both legs of the user from smoothly perform the elliptical exercise trajectory with the two pedals, hence resulting in application difficulties.

Accordingly, it is known from the above that, there is a need for a solution for solving issues of a conventional portable elliptical exercise machine that cannot be applied for a dual use of both sitting and standing postures.

SUMMARY OF THE INVENTION

It is a primary object of the present invention to solve issues of a conventional portable elliptical exercise machine that cannot be applied for a dual use of both sitting and standing postures.

To achieve the above object, the present invention provides a portable sit-stand elliptical exercise machine. The portable sit-stand elliptical exercise machine includes a seat, a transmission wheel installed in the seat and revealing from two opposite sides of the seat, two linkage mechanisms respectively installed at two opposite sides of the transmission wheel and connected to the transmission wheel, and two mobile pedals respectively installed at the linkage mechanisms. The portable sit-stand elliptical exercise machine is characterized that, each of the linkage mechanisms includes a driving portion connected to the transmission wheel, an axle portion disposed correspondingly to the driving portion and at one side away from the transmission wheel, and an adjustment portion disposed between the axle portion and the driving portion. Each of the mobile pedals includes a pivotal portion and a plurality of assembly portions. Further, each of the mobile pedals has a plurality of angles formed by any of the assembly portions installed at the adjustment portion and relative to the linkage mechanism. These angles are different from one another.

In one embodiment, the portable elliptical exercise machine further includes a fixing pin that causes one of the assembly portions to be installed at the adjustment portion. Further, the adjustment portion is a track, and each of the assembly portions is a hole. Further, the assembly portions are in communication with one another.

In one embodiment, the portable elliptical exercise machine further includes a counter disposed at an upper end of the seat. The counter includes an adjustment program that changes a display direction.

In one embodiment, the portable elliptical exercise machine further includes a support plate disposed at a lower portion of the seat. The linkage mechanism further includes a roller that is installed away from the transmission wheel and the axle portion and performs back and forth displacement movements at the support plate when the linkage mechanism is rotated. Further, the portable elliptical exercise machine further includes a dragging handle disposed at the support plate, and a dragging roller disposed at one side of the seat away from the support plate.

In one embodiment, the seat further includes a carrying handle disposed at the upper portion thereof.

Through the above embodiments, the present invention provides following features compared to the prior art.

In the present invention, each of the linkage mechanisms includes the driving portion connected to the transmission wheel, the axle portion disposed correspondingly to the driving portion and at one side away from the transmission wheel, and the adjustment portion disposed between the axle portion and the driving portion. Each of the mobile pedals includes the pivotal portion connected to the axle portion, and the plurality assembly portions. Thus, through the coordination and assembly of the assembly portions and the adjustment portion, one of the angles can be formed between the mobile pedal and the linkage mechanism. As such, one of the angles can be fixedly formed between the mobile pedal and the linkage mechanism, so as to facilitate the user to utilize the portable elliptical exercise machine in either a sitting posture or a standing posture, thereby solving issues of the conventional elliptical exercise machine that cannot be applied for a dual use of both sitting and standing postures.

DETAILED DESCRIPTION OF THE PREFERRED EMBODIMENTS

Details and technical contents of the present invention are given with the accompanying drawings below.

Figure 1:
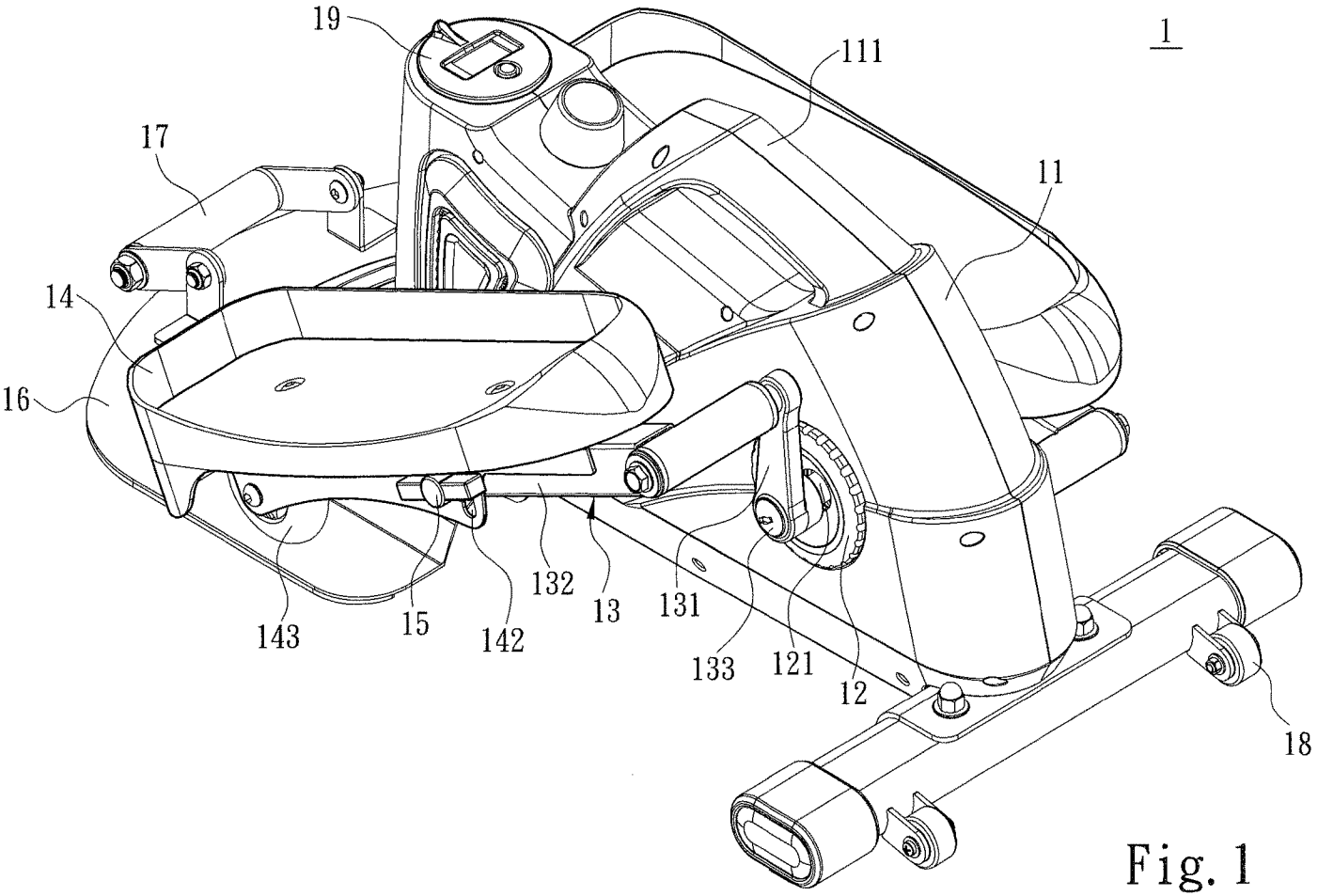
FIG. 1 is a first perspective schematic view of an appearance of the present invention.
Figure 2:
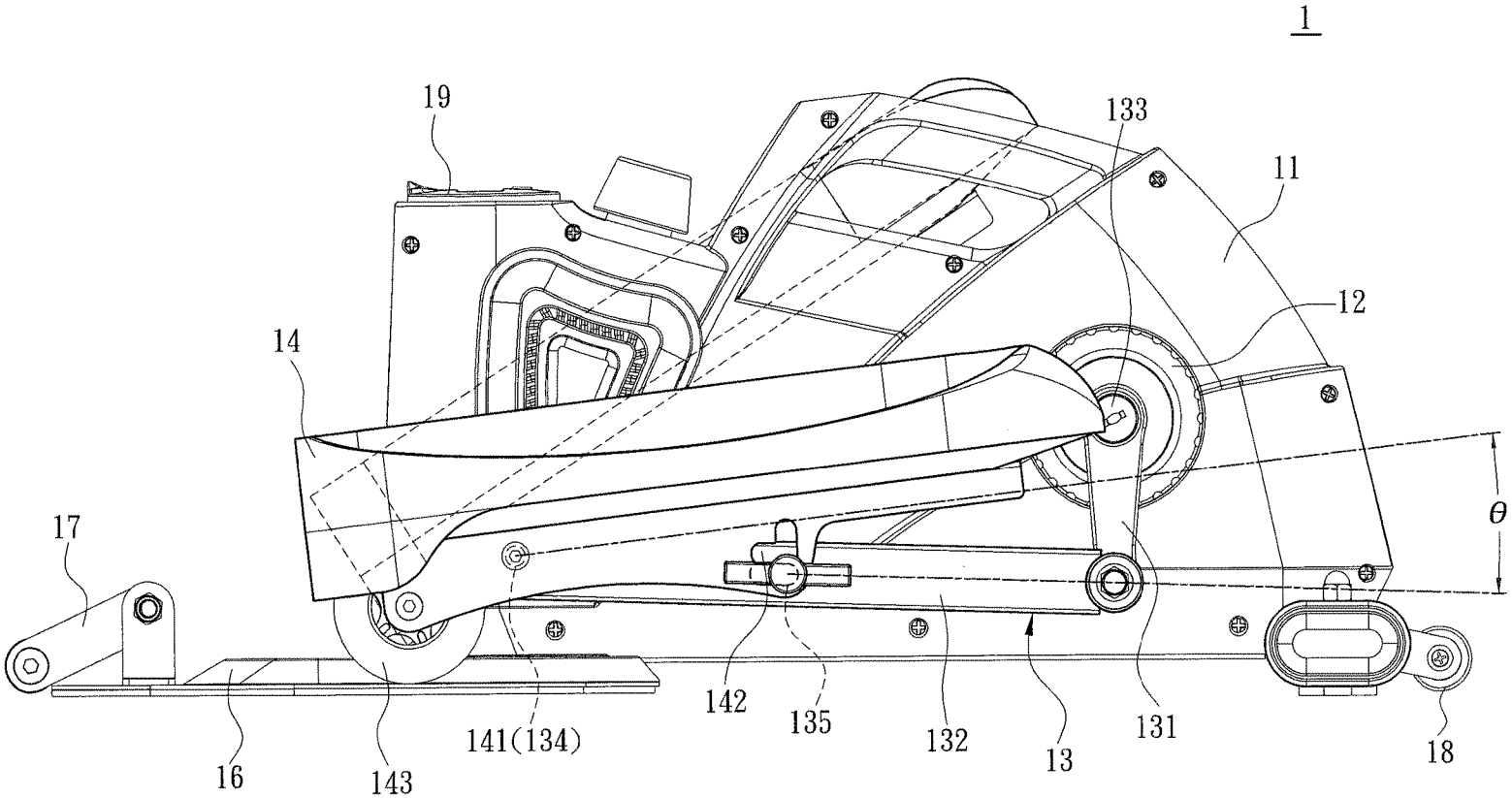
FIG. 2 is a first side view of an implementation of the present invention.
Figure 7:
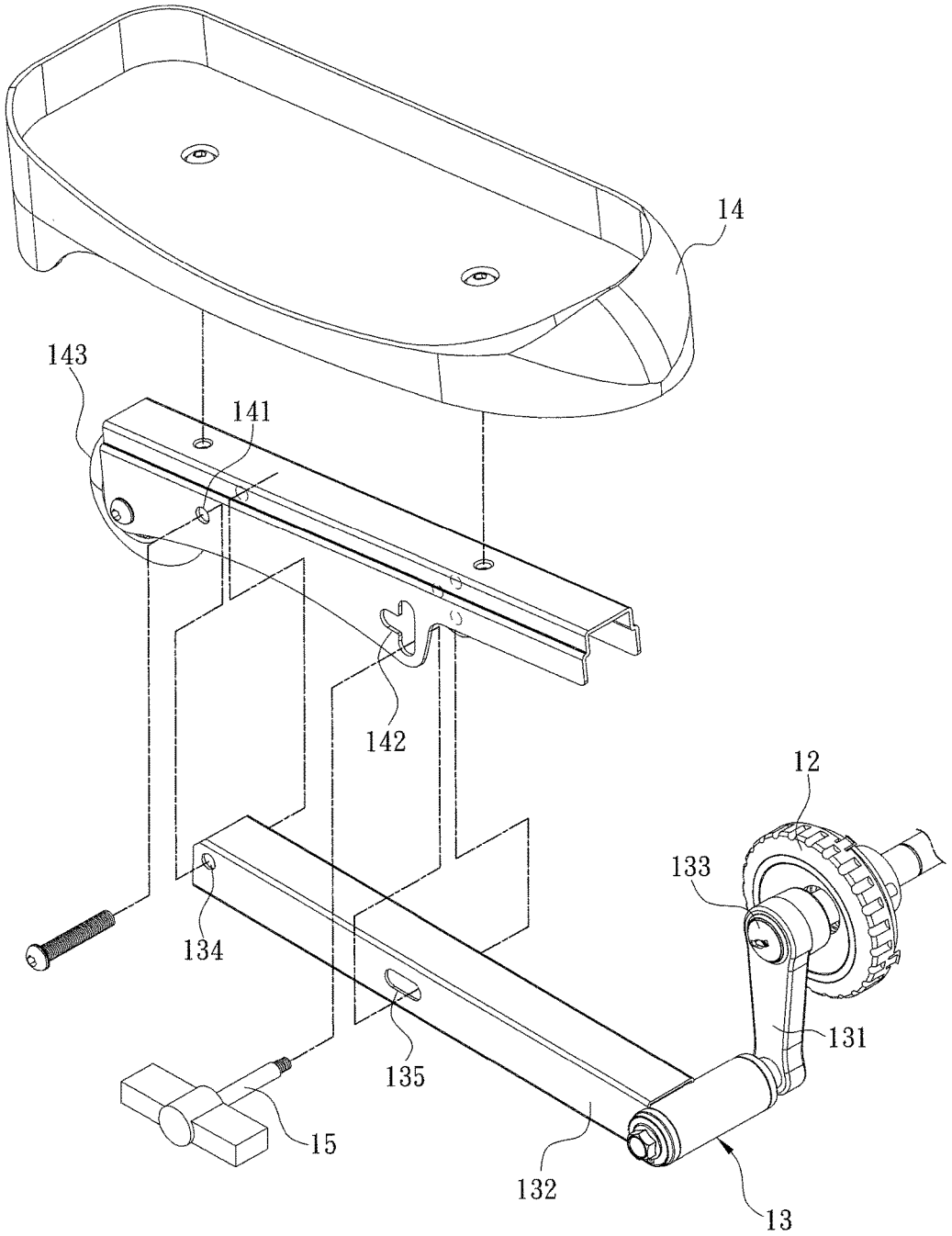
FIG. 7 is a partial exploded view of the present invention.

Referring to FIG. 1, FIG. 2, and FIG. 7, the present invention provides a portable sit-stand elliptical exercise machine 1, which includes a seat 11, a transmission wheel 12, two linkage mechanisms 13 and two mobile pedals 14. The transmission wheel 12 is installed in the seat 11, and reveals from two opposite sides of the seat 11. The two linkage mechanism 13 are installed at two opposite sides of the transmission wheel 12, respectively, and are capable of driving the transmission wheel 12 to rotate. More specifically, the transmission wheel 12 includes a wheel axle 121. Each of the two linkage mechanisms 13 includes a curved shank 131 connected to the wheel axle 121, and a linkage rod 132 connected to the curved shank 131. The two mobile pedals 14 are installed at the linkage mechanisms 13, respectively. Each of the linkage mechanism 13 includes a driving portion 133 connected to the transmission wheel 12, an axle portion 134 disposed correspondingly to the driving portion 133 and at one side away from the transmission wheel 12, and an adjustment portion 135 disposed between the axle portion 134 and the driving portion 133. Each of the mobile pedals 14 includes a pivotal portion 141 connected to the axle portion 134, and a plurality of assembly portions 142 for coordinating with the adjustment portion 135. More specifically, any of the assembly portions 142 of the mobile pedal 14 is adapted to be assembled to the adjustment portion 135, such that an angle θ between the mobile pedal 14 and the linkage mechanism 13 is formed. These angles θ are different from one another. The portable elliptical exercise machine 1 further includes two fixing pins 15 respectively fixed at the adjustment portion 135 and one of the assembly portions 142. In one embodiment, each of the two adjustment portions 135 is a track, and each of the assembly portions 142 is a hole. The assembly portions 142 may be in communication with one another to form a T-shaped hole. The two fixing pins 15 may be inserted and fixed at the adjustment portion 135 and one of the assembly portions 142, respectively, such that one of the angles θ is formed between the mobile pedal 14 and the linkage mechanism 13.

More specifically, again referring to FIG. 1, FIG. 2 and FIG. 7, the portable elliptical exercise machine 1 further includes a support plate 16 disposed at a lower portion of the seat 11. The mobile pedal 14 further includes a pulley 143 installed away from the transmission wheel 12 and the axle portion 134. Further, when the two linkage mechanisms 13 drive the transmission wheel 12 to rotate, the two pulleys 143 perform back and forth displacement movements at the support plate 16. Further, each of the two pulleys 143 is installed at the linkage rod 132 away from the curved shank 131.

Accordingly, the overall structure of the portable elliptical exercise machine 1 is clearly described as above. To better illustrate the implementation process of the portable elliptical exercise machine 1, operations of members including the linkage mechanism 13 and the mobile pedal 14 at one side of the portable elliptical exercise machine 1 are described below. Referring to FIG. 1 to FIG. 4, when applying the present invention, a user may utilize the portable elliptical exercise machine 1 in either a sitting posture or a standing posture. For the sitting posture, the user may first sit on a chair (not shown), and place the portable elliptical exercise machine 1 on the ground in front of the chair. The user may then place a foot on the mobile pedal 14 to perform an elliptical exercise trajectory. More specifically, taking FIG. 2 to FIG. 4 for example, when the user applies the portable elliptical exercise machine 1 in a sitting posture, a foot of the user treads on the mobile pedal 14 from the left side of FIG. 2 to FIG. 4 (i.e., the face of the user faces the right side of FIG. 2 to FIG. 4), performs the elliptical exercise trajectory through the mobile pedal 14 that drives the transmission wheel 12 to rotate, and causes the pulley 143 to display back and forth displacement movements at the support plate 16. On the other hand, for a standing posture, the user may stand and tread on the mobile pedal 14 from the right side of FIG. 2 to FIG. 4 (i.e., the face of the user faces the left side of FIG. 2 to FIG. 4), and perform the elliptical exercise trajectory through the mobile pedal 14 that drives the transmission wheel 12 to rotate (i.e., along a counterclockwise direction in FIG. 2 to FIG. 4).

Figure 3:
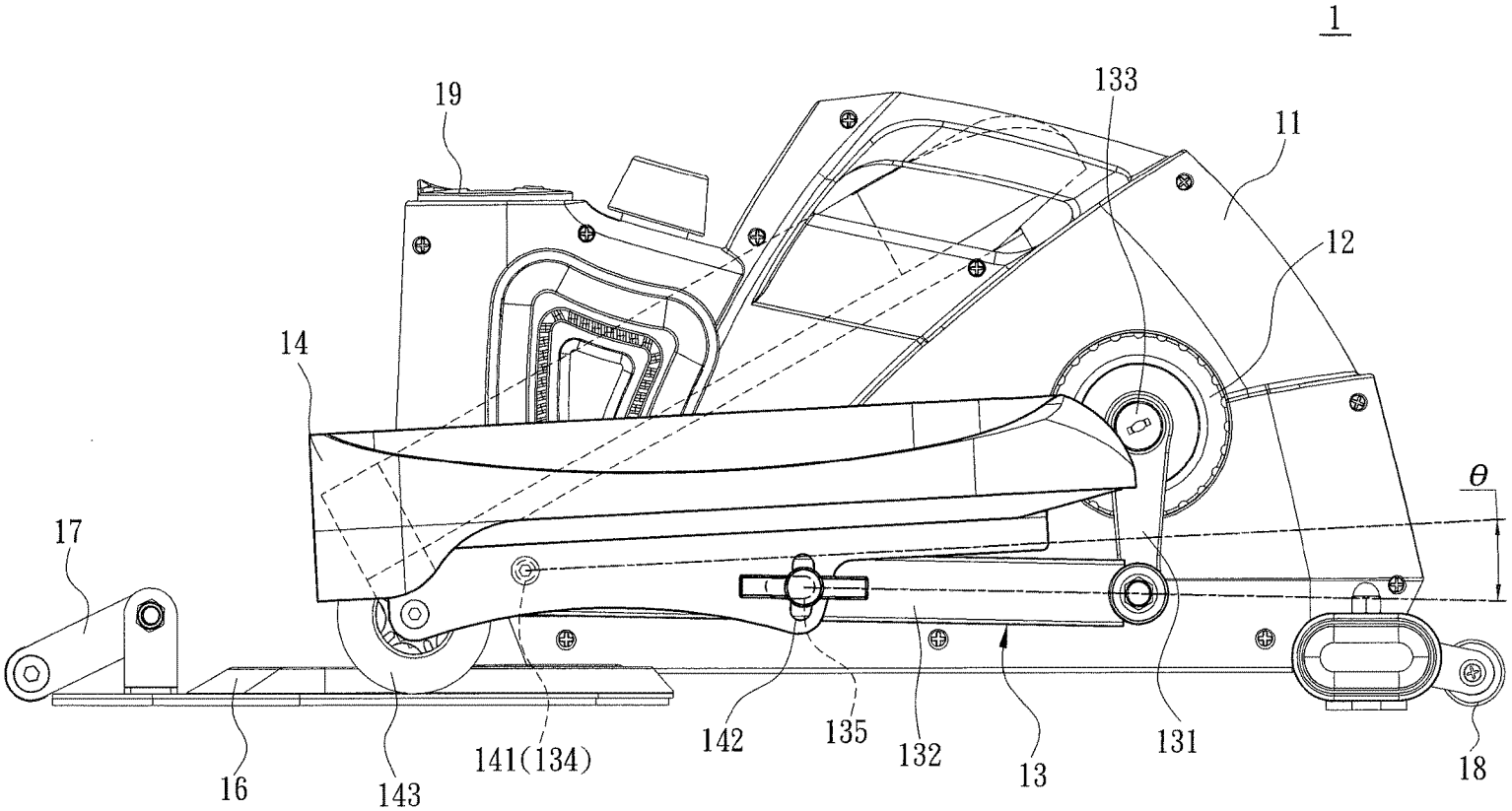
FIG. 3 is a second side view of an implementation of the present invention.
Figure 4:
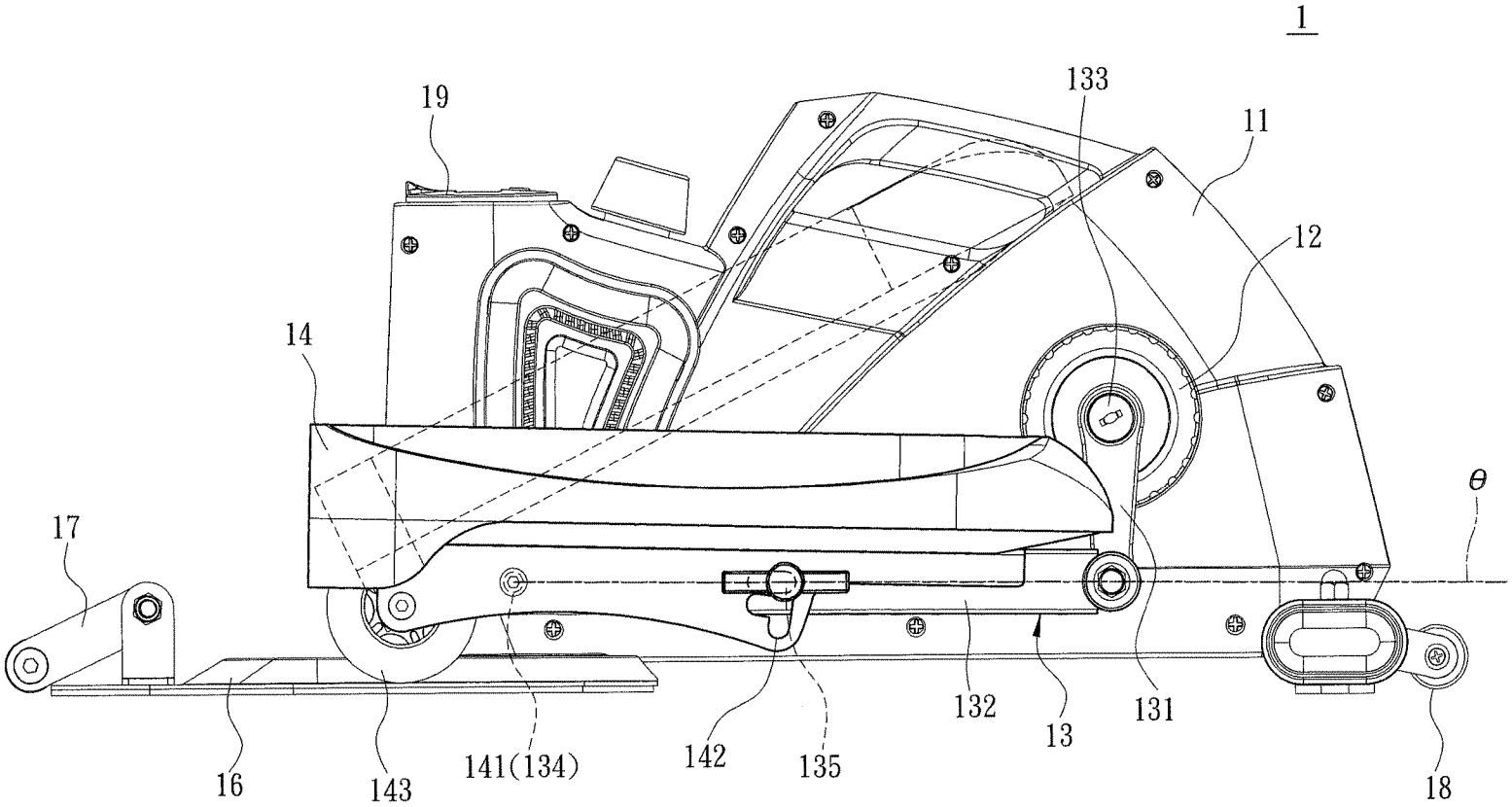
FIG. 4 is a third side view of an implementation of the present invention.
Figure 5:
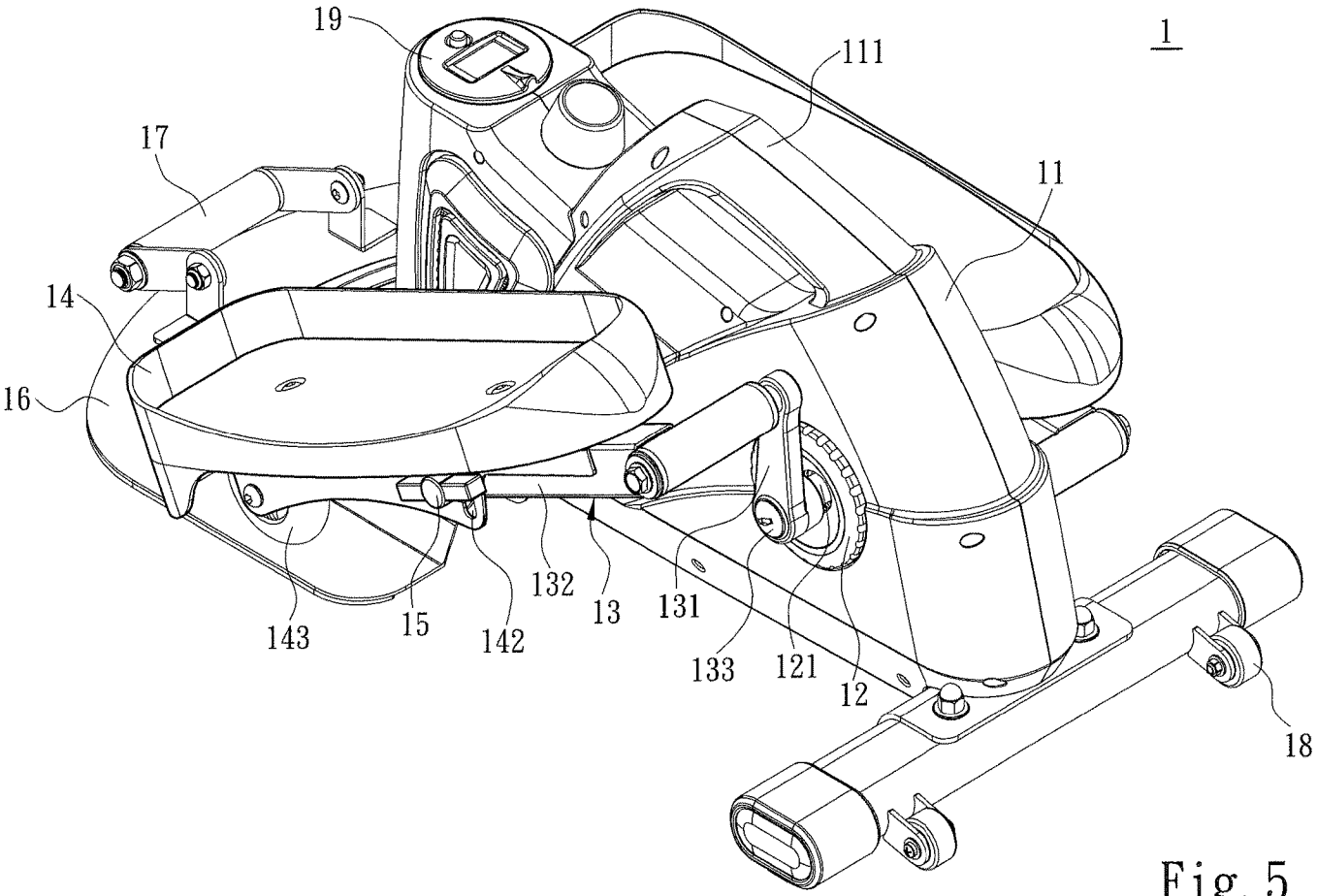
FIG. 5 is a second perspective schematic view of an appearance of the present invention.

More specifically, when the user utilizes the portable elliptical exercise machine 1 in a sitting posture, the user may first rotate the mobile pedal 14 upwards by regarding the axle portion 134 as a center (i.e., along a counterclockwise direction in FIG. 2 to FIG. 4). After the mobile pedal 14 and the linkage mechanism 13 form one of the angles θ, the user may fix one of the assembly portions 142 at the adjustment portion 135. Thus, the mobile pedal 14 is secured relative to the linkage mechanism 13, such that user discomfort is not caused due to a flat position of the mobile pedal 14 when the foot of the user treads on the mobile pedal 14. More specifically, while the user rotates the mobile pedal 14, the user may first loosen or remove the fixing pin 15 from one of the assembly portion 142 and the adjustment portion 135, and rotate and adjust the mobile pedal 14 by regarding the axle portion 134 as an axle. When one of the appropriate angles θ is formed between the mobile pedal 14 and the linkage mechanism 13, the adjustment portion 135 is aligned with one of the assembly portions 142. The user may then insert and fix the fixing pin 15 at one of the assembly portions 142 and the adjustment portion 135, such that one of the angles θ is formed between the mobile pedal 14 and the linkage mechanism 13. On the other hand, before the user utilizes the portable elliptical exercise machine 1 in a standing posture, the user may rotate the mobile pedal 14 downwards by regarding the axle portion 134 as a center (i.e., the clockwise direction in FIG. 2 to FIG. 4). Thus, the mobile pedal 14 is secured relative to the linkage mechanism 13 and one of the angles θ is formed, such the user is allowed to tread on the mobile pedal 14 to perform the elliptical exercise trajectory, and is not hindered from properly standing and treading on the mobile pedal 14 due to the mobile pedal 14 positioned at an excessively inclined angle. Therefore, through the coordination and assembly between the assembly portions 142 and the adjustment portion 135, one of the angles θ can be formed between the mobile pedal 14 and the linkage mechanism 13, so as to facilitate the user to utilize the portable elliptical exercise machine 1 in either a sitting posture or a standing posture, thereby solving issues of a conventional elliptical exercise machine that cannot be applied for a dual use of both sitting and standing postures.

Again referring to FIG. 1 to FIG. 5, because the portable elliptical exercise machine 1 can be utilized by a user in either a sitting posture or a standing posture, in one embodiment, the portable elliptical exercise machine 1 further includes a counter 19 disposed at an upper end of the seat 11. The counter 19 includes an adjustment program that changes a display direction. In an implementation process of the present invention, when the user utilizes the portable elliptical exercise machine 1 in a sitting posture, a display direction of the counter 19 can be adjusted through adjusting the adjustment program, so as to allow data (e.g., workout time, calories burned or exercise speed) displayed by the counter 19 to be presented in a forward and upright direction to the eyes of the user. On the other hand, when the user utilizes the portable elliptical exercise machine 1 in a standing posture, the counter 19 may also be rotated by 180 degrees through the adjustment program, so as to allow the user to view the data displayed by the counter 19 in a forward and upright direction. More specifically, the seat 11 includes an embedding hole (not shown) disposed at an upper portion. The counter 19 may be installed in the embedded hole in a forward or reverse direction, such that the user is allowed to view the data displayed by the counter 19 in a forward and upright direction when the user utilizes the portable elliptical exercise machine 1 in either a sitting posture or a standing posture.

Figure 6:
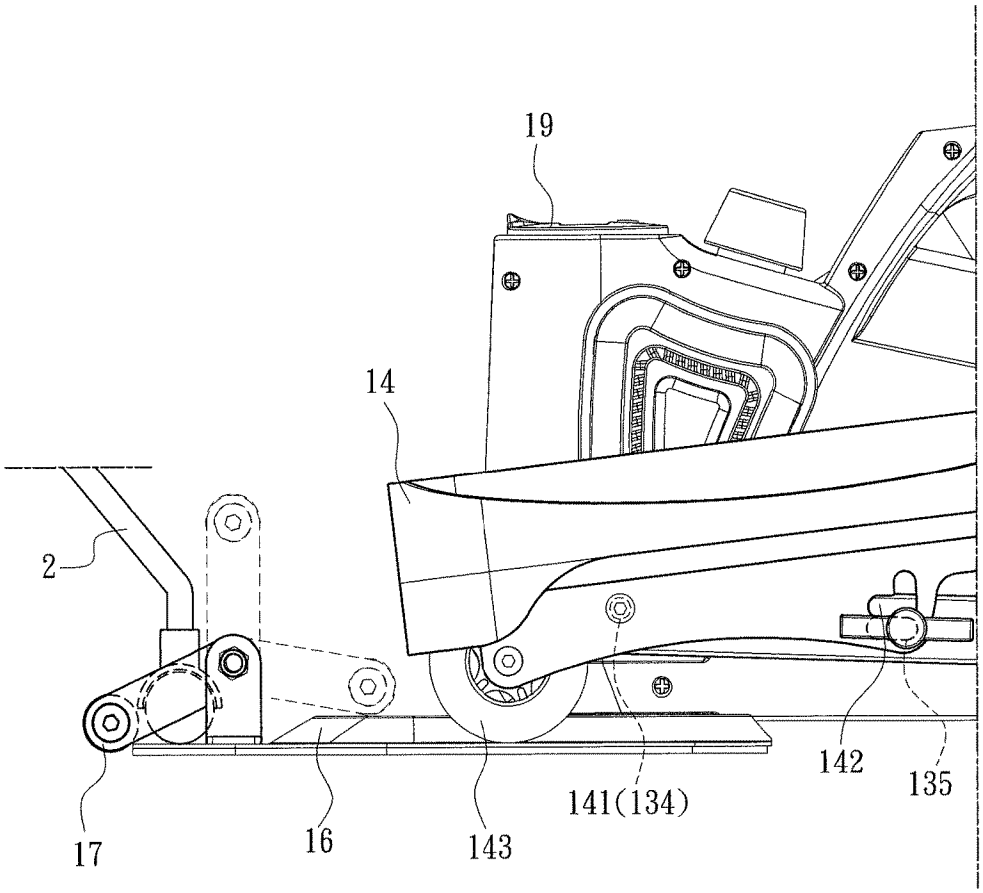
FIG. 6 is a fourth side view of an implementation of the present invention.

Again referring to FIG. 1 to FIG. 5, as the portable elliptical exercise machine 1 is readily portable by the user, in one embodiment, the seat 11 further includes a carrying handle 111 disposed at an upper portion of the seat 11 to allow the user to carry the portable elliptical exercise machine 1 using the carrying handle 111. In another embodiment, as shown in FIG. 1 to FIG. 5, the portable elliptical exercise machine 1 further includes dragging handle 17 disposed at the support plate 16, and a dragging roller 18 disposed at one side of the seat 11 away from the support plate 16. When the user moves the portable elliptical exercise machine 1, the user may hold the dragging handle 17 and perform a dragging operation through the dragging roller 18, thereby enhancing the portability of the portable elliptical exercise machine 1. Further, again referring to FIG. 1 to FIG. 6, the dragging handle 17 may be a mobile joint. That is to say, the dragging handle 17 may collapse towards the support plate 16, or collapse away from the support plate 16 (as shown in FIG. 6). Further, when the seat 11 that the user utilizes is an office chair with a roller 2, the user may fasten the roller 2 at the lower part of the office chair into a circular region formed by the dragging handle 17 in a fallen position (as shown in FIG. 1 and FIG. 6), thereby preventing the user from sliding caused by the roller 2 when the user utilizes the portable elliptical exercise machine 1 with the office chair.

What is claimed is:

1. A portable sit-stand elliptical exercise machine, comprising:

a seat;

a transmission wheel, installed in the seat and revealing from two opposite sides of the seat;

two connection members, respectively installed at two opposite sides of the transmission wheel and adapted to drive the transmission wheel in a linked manner, wherein each of the connection members comprises a transmission rod connected to the transmission wheel, an axle portion disposed correspondingly to the transmission rod and at one side away from the transmission wheel, and a track disposed between the axle portion and the transmission rod; and two mobile pedals respectively installed at the connection members, wherein each of the mobile pedals comprises a pivotal portion connected to the axle portion and a plurality of holes in communication with each other to form a T-shaped hole, wherein the plurality of holes are installed on the track through a fixing pin to provide different angles between each mobile pedal and the respective connection member, and wherein a selection between a maximum and a minimum of the different angles corresponds to a substantially vertical travel of the track along the T-shaped hole.

2. The portable sit-stand elliptical exercise machine of claim 1, further comprising a counter disposed at an upper end of the seat, and the counter includes an adjustment program that changes a display direction.

3. The portable sit-stand elliptical exercise machine of claim 1, further comprising a support plate disposed at a lower portion of the seat, and the connection member further comprises a pulley installed away from the transmission wheel and the axle portion and performing back and forth displacement movements at the support plate when the connection member is rotated.

4. The portable sit-stand elliptical exercise machine of claim 3, further comprising a dragging handle disposed at the support plate, and a dragging roller disposed at one side of the seat away from the support plate.

5. The portable sit-stand elliptical exercise machine of claim 1, wherein the seat further comprises a carrying handle disposed at an upper portion thereof.

* * * * *